US007963204B2

(12) United States Patent
Venton-Walters et al.

(10) Patent No.: US 7,963,204 B2
(45) Date of Patent: Jun. 21, 2011

(54) STRESSED SKIN TILED VEHICLE ARMOR

(75) Inventors: Roy Venton-Walters, Neshkoro, WI (US); Robert M. Hathaway, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 840 days.

(21) Appl. No.: 11/880,739

(22) Filed: Jul. 24, 2007

(65) Prior Publication Data

US 2011/0120293 A1 May 26, 2011

(51) Int. Cl.
*F41H 5/02* (2006.01)

(52) U.S. Cl. ..... 89/36.02; 89/36.07; 89/36.08; 89/36.09; 89/904; 89/917; 428/911; 109/49.5; 296/187.07

(58) Field of Classification Search ..... 89/36.02, 89/36.07, 36.08, 36.09, 36.11; 428/911; 109/49.5; 296/187.07
See application file for complete search history.

(56) References Cited

U.S. PATENT DOCUMENTS

| | | | | | |
|---|---|---|---|---|---|
| 2,102,963 | A | * | 12/1937 | Miller | 148/211 |
| 2,201,202 | A | * | 5/1940 | Reed | 148/233 |
| RE22,072 | E | * | 4/1942 | Selmi | 420/109 |
| 2,342,104 | A | * | 2/1944 | Holt | 148/220 |
| 3,157,090 | A | | 11/1964 | Ballu | |
| 4,040,333 | A | * | 8/1977 | Slysh | 89/37.16 |
| 4,090,011 | A | | 5/1978 | Barkman et al. | |
| 4,100,860 | A | * | 7/1978 | Gablin et al. | 109/83 |
| 4,232,069 | A | * | 11/1980 | Windecker | 428/47 |
| 4,879,165 | A | * | 11/1989 | Smith | 428/212 |
| 4,923,741 | A | * | 5/1990 | Kosmo et al. | 442/187 |
| 4,953,442 | A | * | 9/1990 | Bartuski | 89/36.02 |
| 5,170,690 | A | * | 12/1992 | Smirlock et al. | 89/36.08 |
| 5,190,802 | A | * | 3/1993 | Pilato | 428/111 |
| 5,312,693 | A | * | 5/1994 | Paul | 428/554 |
| 5,333,532 | A | | 8/1994 | Smirlock et al. | |
| 5,402,730 | A | | 4/1995 | Salter et al. | |
| 5,443,917 | A | * | 8/1995 | Tarry | 428/545 |
| 6,205,728 | B1 | * | 3/2001 | Sutelan | 52/309.7 |
| 6,327,954 | B1 | * | 12/2001 | Medlin | 89/36.08 |
| 7,383,761 | B2 | * | 6/2008 | Warren et al. | 89/36.02 |
| 7,628,104 | B2 | * | 12/2009 | Warren et al. | 89/36.02 |
| 2008/0282876 | A1 | * | 11/2008 | Leivesley et al. | 89/36.02 |
| 2009/0178597 | A1 | * | 7/2009 | Sliwa, Jr. | 109/49.5 |
| 2010/0005955 | A1 | * | 1/2010 | Ohnstad et al. | 89/36.02 |
| 2010/0043630 | A1 | * | 2/2010 | Sayre et al. | 89/36.02 |

FOREIGN PATENT DOCUMENTS

| | | | |
|---|---|---|---|
| DE | 37 16055 | A1 | 12/1988 |
| GB | 2 260 600 | A | 4/1993 |
| WO | WO 93/21492 | A1 | 10/1993 |
| WO | WO 94/24894 | A1 | 11/1994 |

* cited by examiner

*Primary Examiner* — Bret Hayes
*Assistant Examiner* — Michael D David
(74) *Attorney, Agent, or Firm* — Foley & Lardner LLP

(57) ABSTRACT

Vehicle armor includes a body panel of the vehicle having a stressed skin construction with an inside surface and an outside surface. A liner overlies the inside surface of the body panel and a particle-filled elastomer overlies the outside surface of the body panel. Thin, single-layer steel tiles overlie the elastomer layer, with the tiles each having a hardened outer side and a non-hardened inner side.

7 Claims, 3 Drawing Sheets

FIGURE 1
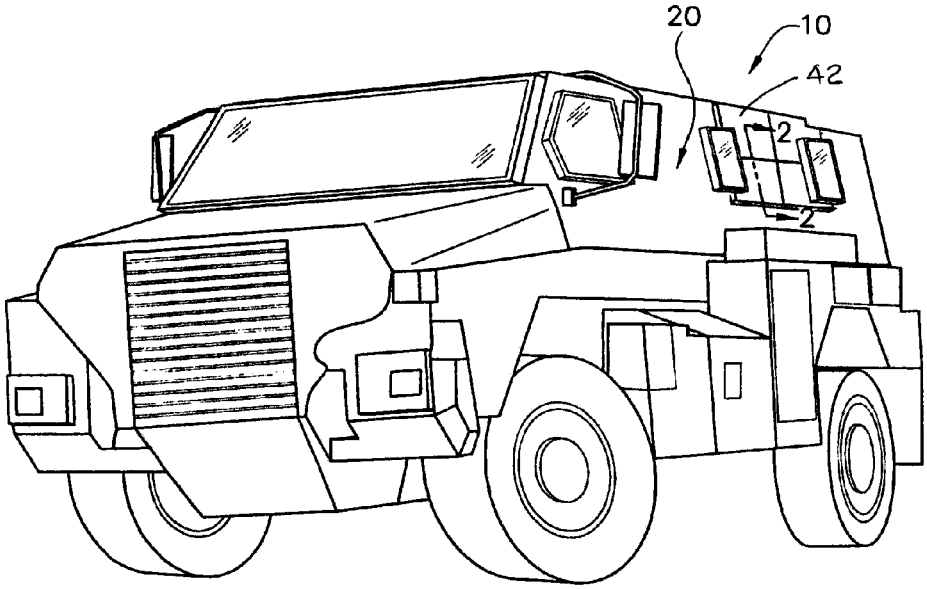
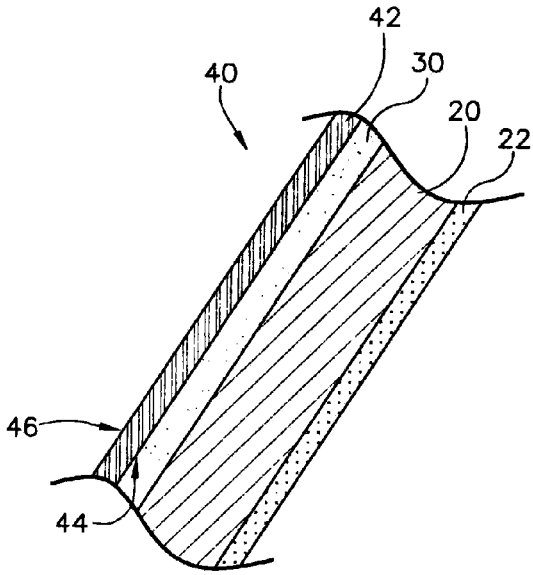
FIGURE 2

FIGURE 3
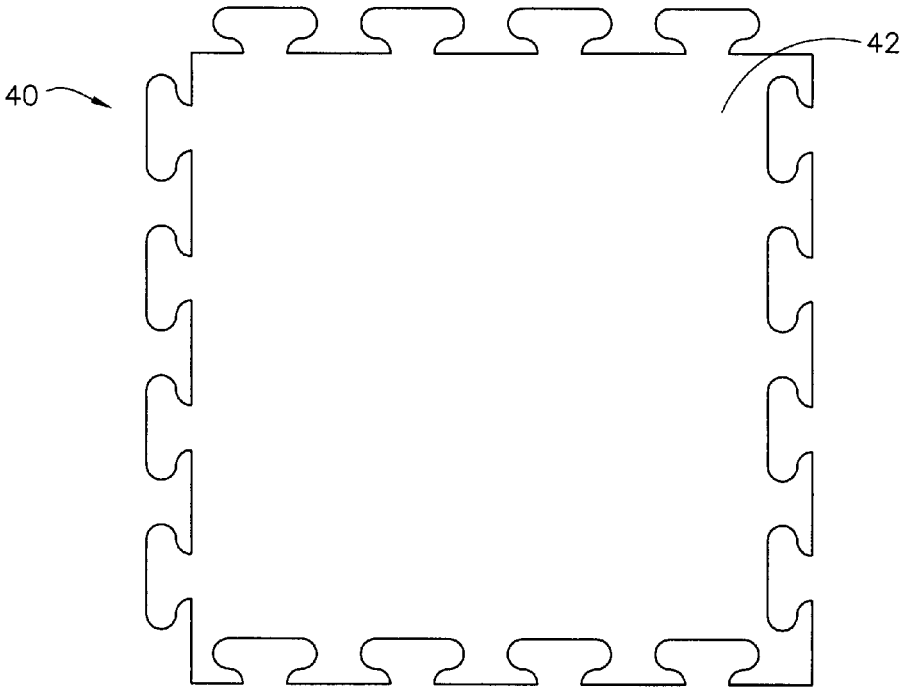
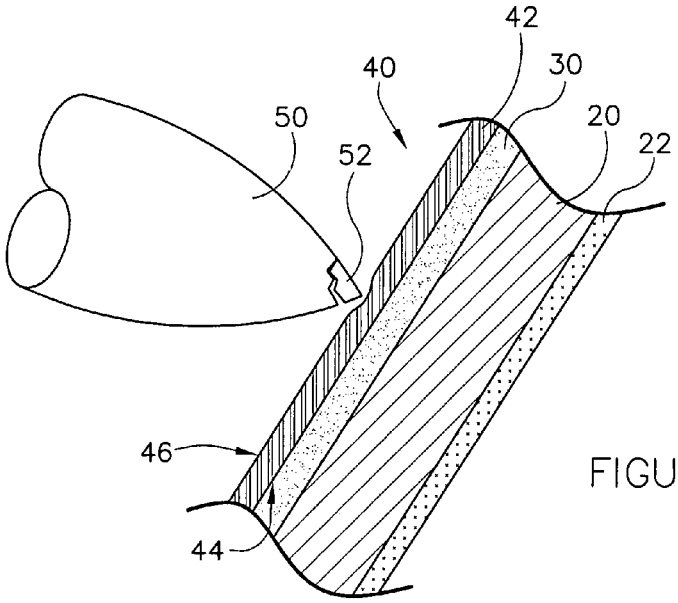
FIGURE 4

STRESSED SKIN TILED VEHICLE ARMOR

FIELD

The present invention relates to vehicle armor. The present invention relates more particularly to a lightweight vehicle armor system that includes a thin steel tile having a hardened surface on one side and a tough, energy-absorbing surface on the other side, overlying a dense elastomer, which overlies a vehicle body.

BACKGROUND

Armor system for vehicles (such as military vehicles and the like) are generally known and may include an armored skin material (such as ceramic tiles) covering the vehicle. The type of armored vehicle skin typically used to provide protection to the occupants and operating systems of a vehicle may be classified on certain established criteria, such as "probability of kill" (Pk) criteria. Statistically, even a modest level of armor protection greater than a basic vehicular "soft body" can be shown to reduce (Pk), with a more significant reduction in (Pk) for most battlefield scenarios once protection from low energy threats such as blast fragmentation or light arms fire has been achieved. As armor protection level is increased, the (Pk) further reduces, but usually at the expense of disproportional increases in vehicle weight and manufacturing cost. Accordingly, it would be advantageous to advance the technology of lightweight, low cost armor solutions for vehicles.

Generally, the threat type that vehicle armor protection may encounter might first be classified as either blast or projectile (although most threats combine both to some lesser or greater extent). For example, artillery rounds, some mines, rocket propelled grenades (RPGs) and improvised explosive devices (IEDs) often combine both effects.

Blast type threats may be considered largely as a "pressure effect", and the armored skin materials and thickness considered necessary to protect occupants and vehicle systems is not only dependent on the size of the blast, but also on the distance from the blast and the portion of the blast actually reacted by the vehicle. In other words; the shape, size and orientation of the surfaces exposed to the blast wave are factors for consideration in designing an effective vehicle armor system.

In general, the occupants of "light" vehicles are inherently more vulnerable to blast than in a "heavy" armored vehicle because a given blast intensity will tend to impose greater accelerations on a lighter mass than a heavier one. In this respect, for a given blast survival capability for a minimum vehicle weight, consideration is given to mitigating the effects of blast accelerations on the vehicle occupants. Such considerations usually are based upon human medical factors including methods of reducing the occupants' spinal loading in mine type (e.g. below-ground) blast events, as well as methods of reducing, longitudinal and lateral accelerations and consequential impact of the occupants within the vehicle's internal structure caused by both a mine blast event and above-ground blast events. Information from helicopter seat design and automobile crash testing, including side crash tests, have shown that the human medical factors approach in design tends to improve occupant survivability. Accordingly, the lessons learned and techniques developed in automotive crash design; e.g., occupant restraint and air-bag protection, may well be applicable to designing armor systems for survival of light military vehicles from above-ground and below ground blast events.

Generally, for a design that minimizes occupant injury during a blast event, the vehicle's armor skin thickness should withstand any blast event up to the limit of occupant survival. Beyond that, structural redundancy, if not beneficial to projectile protection, tends to result in excess weight and degradation of such otherwise desirable parameters as vehicle acceleration, grade capability, handling, roll-stability, payload capacity, fuel efficiency, transportability and mobility.

Design of an armor system for a vehicle that is capable of withstanding projectile threats tends to present a different set of challenges and covers a wide spectrum of possible threats where the effects of the projectile are intended to concentrate their energy on a very localized area of the armor to breach the armor's protection. Projectile threats are typically grouped as kinetic energy projectile or chemical energy projectile types.

Both kinetic and chemical energy projectile types typically use the physical properties of mass and velocity to impart a high level of energy to a small area. Certain kinetic projectiles use the velocity of the projectile to the target (for example, typically within a range of 700 to 4,500 miles per hour (mph)), and certain chemical projectiles use an explosive chemical energy charge to reshape a metal billet into a higher velocity (for example, about 15,000 mph) projectile in the form of a solid jet or slug of metal.

Kinetic projectiles types typically range from small fragments and bullets (at a lower end of the scale) through specialized armor piercing bullets and may include substantial depleted uranium penetrator rods (at an upper end of the scale).

Since the more advanced chemical and kinetic projectiles typically in use lately are often capable of breaching hardened steel plate having a thickness of a foot or more, it is generally considered impractical for any vehicle, even the heaviest and most advanced battle tank, to be effectively armored "against all threats". Thus, a threat/force protection strategy for any vehicle type is usually a compromise between detectability (e.g. stealth), armor protection, and mobility; with mobility often influencing survivability and typically degrading with increased vehicle weight (i.e. increasing levels of conventional armor protection).

Accordingly, it would be desirable to provide a lightweight vehicle armor system that is capable of providing a desired level of occupant and vehicle system survivability protection for both blast and projectile type threats. It would also be desirable to provide a lightweight vehicle armor system includes a lightweight high tensile aluminum alloy body panel of the vehicle combined with a thin, boronized, case-hardened steel tiles with a dense particle-filled elastomer provided therebetween to spread local impact loads and dissipate some of the impact energy laterally. It would be desirable to provide a lightweight vehicle armor system that is intended to provide the advantage of being relatively inexpensive compared with conventional ceramic tile laminate armor systems, while being lightweight when compared with conventional hardened steel solutions. It would be desirable to provide a lightweight vehicle armor system that is readily adaptable for use with vehicle body panels having a stressed skin construction.

Accordingly, it would be desirable to provide a lightweight vehicle armor system having any one or more of these or other desirable features.

SUMMARY

According to one aspect of the invention, the vehicle armor includes a body panel having an inside surface and an outside surface, with a liner overlying the inside surface of the body panel and an elastomer layer overlying the outside surface of the body panel, and a thin, single layer steel tiles overlying the elastomer layer, with the tiles each having a hardened outer side and a non-hardened inner side.

According to another aspect of the invention, the vehicle armor includes a body panel layer comprising an aluminum alloy and a particle-filled elastomer layer overlying the body panel. An armor layer overlies the elastomer layer, with the armor layer having a single-layer low carbon steel plates hardened on one side to provide a hard outer region, and non-hardened on the opposite side to provide a tough, energy-absorbing inner region adjacent to the elastomer layer.

According to a further aspect of the invention, a method for providing the vehicle armor includes providing a vehicle having a body, and applying an elastomer to an outside surface of the body, and providing single-layer steel tiles, and diffusion hardening only one side of the tiles to a predetermined depth to provide a hardened exterior region, and coupling the tiles to the elastomer layer.

BRIEF DESCRIPTION OF THE DRAWINGS

FIG. 1 is a schematic image of a perspective view of the vehicle armor according to an exemplary embodiment.

FIG. 2 is a schematic image of a detailed cross sectional view of the vehicle armor along line 2-2 according to the embodiment of FIG. 1.

FIG. 3 is a schematic image of an elevation view of a portion of the vehicle armor according the embodiment of FIG. 1.

FIG. 4 is a schematic image of a detailed cross sectional view of the vehicle armor according to the embodiment of FIG. 2 upon impact by a projectile at a first stage.

DETAILED DESCRIPTION

Figure 5:
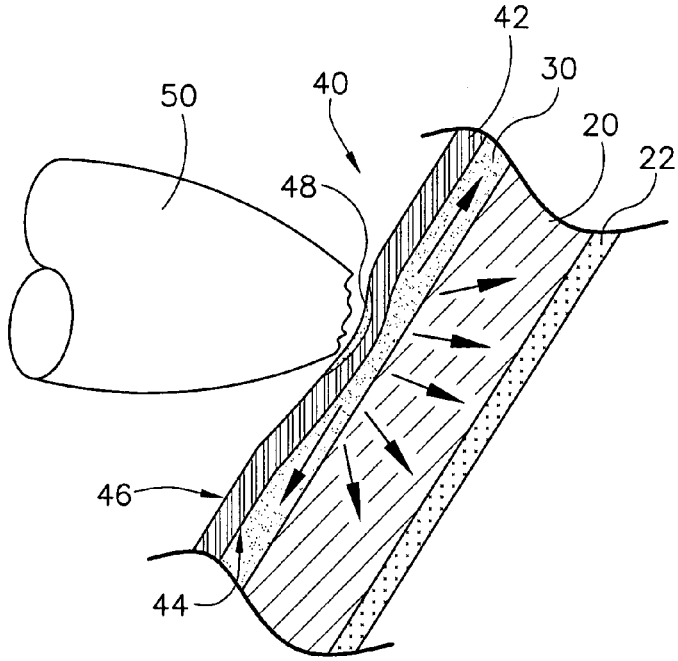
FIG. 5 is a schematic image of a detailed cross sectional view of the vehicle armor according to the embodiment of FIG. 2 upon impact by a projectile at a second stage.

Referring to the FIGURES, vehicle armor (e.g. shown for example as a lightweight vehicle armor system) is shown according to an exemplary embodiment. The armor is shown to include a "layered" or "laminate" type construction integrated with at least a portion of a body panel of the vehicle. An elastomer (such as a dense, particle-filled elastomer) is shown applied over an outer surface of the body panel and a single layer of thin steel tiles are applied over (and attached or adhered or bonded to) the elastomer. The single layer of thin steel tiles are formed having a first (outer) side that is surface hardened for fragmenting an impinging projectile and an second (inside) surface that is tough, energy-absorbing to permit deformation of the tile for impact energy absorption and distribution. The particle-filled elastomer provides additional impact energy absorption and distribution.

The body panel of the vehicle is shown and described by way of example to be formed as a "stressed skin" type construction from an aluminum alloy, and the thin steel tiles are shown to be formed from a single sheet (e.g. panel. etc.) of ductile low-carbon steel with one (outer) side carburized and the other (inner) side coated to prevent carburization and retain its toughness. However, the invention is adaptable with any of a wide variety of body panel materials and constructions. Also, any of a wide variety of interposing materials or bonding agents for coupling the tiles to the body panel and for absorbing or dissipating or distributing impact energy may be used. Further, any of a wide variety of hardening techniques or procedures may be used to provide a thin steel tile with one side having a ductile or tough region and the other side having a hardened region. Such variations and combinations thereof will be readily apparent to a person of ordinary skill in the art after reviewing this disclosure. Accordingly, all such modifications and variations are intended to be within the scope of the invention.

Referring to FIG. 1, a vehicle (shown for example as a light military wheeled vehicle or truck) having a lightweight armor system is shown according to an exemplary embodiment. Vehicle 10 includes a body 20 (e.g. shell, structure, panels, sheets, etc.) constructed (for example) using a stressed skin type construction comprising aluminum alloy sheets, forgings and/or castings that may assembled together using any suitable technique, such as friction-stir-welding (FSW). The FSW technique is intended to enable the use of alloys having high dynamic tensile strength whose composition and heat treatment might otherwise render the parts difficult to weld together with adequate joint integrity and without subsequent heat treatment of the welded assembly. The stressed skin structure may form most or all of the body of the vehicle, or may be provided as multiple modular sections which, when connected to other modular section(s), will combine to provide a substantially complete assembly for a body of the vehicle. According to one embodiment the aluminum alloy material is AA5083 per MIL-DTL-46027. According to alternative embodiments, the body portion may be formed from a 7000 heat treated series aluminum or any other suitable material, including but not limited to a MIL-A-46177 steel, stainless steel, titanium, etc.

Referring to FIG. 2, a cross section of the laminated or layered armor for the vehicle 10 is shown according to an exemplary embodiment. The vehicle armor is integrated with the body 20, and includes the body 20, and a layer of bonding agent 30 (such as a dense, particle-filled elastomer), and a layer of armor applied over the elastomer 30. The thickness of the aluminum structure of the body 20 is generally defined by its ability to react to the static and dynamic loadings to which it is subjected during operation of the vehicle 10. These loadings include those arising from acceleration and mobility over severe off-road terrain, forces due to static or quasi-static loadings, forces encountered during transportation, and forces due to blast and projectile type impacts. According to one embodiment, a thickness of the body is within a range of approximately 0.25 to 3.0 inches.

Referring to FIGS. 2-3, the layer of armor 40 is formed as a single layer from a series of individual tiles 42 according to an exemplary embodiment. The tiles 42 are relatively thin tiles intended to minimize the additional weight imposed on the vehicle by the armor. According to one embodiment, a thickness of the tiles is within a range of approximately 0.08 to 0.75 inches. The tiles of the present embodiment are formed from a low-carbon steel in a suitable size such that distortions due to the tile's subsequent heat treatment will have a negligible effect on the vehicle's manufacturing process, or the detectable radar reflectivity of the outer surface of the tiles. According to one embodiment, the tiles are made of a tough, low-carbon steel plate that will not harden when heated to red heat and quenched in water or oil. Such a steel can be that known as "Domex" which has a nominal carbon content of approximately 0.17% and a nominal yield strength of approximately 115 ksi. Other similar steel alloys may also be suitable. For example, steel alloys having a nominal carbon weight percentage within a range of approximately 0.05% to 0.32%, and a nominal yield strength within the range of 80 to 150 ksi, may also be used to create a tile that integrates one hardened side/region with an opposite tough, energy-absorbing side/region in a single plate intended to minimize weight, reduce cost, simplify manufacturing operations, and meet the desired protection performance from the impact energy of blast and projectile type threats.

Referring further to FIG. 3, the typical shape or plan form of an exemplary tile 42 is shown as generally planar and square or rectangular, where the outer perimeter edges are shaped to couple or interlock with each other in a "jigsaw" like manner. According to one embodiment, the tiles have a height and width within the range of approximately 1 to 60 inches. According to alternative embodiments, the tiles may have any of a wide variety of shapes (e.g. circular, triangular, pentagonal, hexagonal, octagonal, etc.), and may be convex, concave, or contoured in any suitable manner to conform to the outside shape of the body portion, or to enhance the space between the tiles and the body portion for increased energy absorption, distribution, and/or dissipation. The tiles may also have any suitable size and may interface with one another in any suitable manner, such as mating projections and recesses, or may simply have a generally smooth interface.

According to one embodiment, the tiles 42 are formed from plates of low-carbon steel having the desired toughness properties (as previously described) for use on an inner side/region of the tile 42. The tiles 42 are then transformed by a manufacturing processes into a single tile that retains the original characteristics of a tough (non-hardened) inner side/region 44 and forms a hardened outer side/region 46. According to one embodiment of the manufacturing process, the low-carbon steel tiles are hardened on the outer side 46 only, through a diffusion hardening process to produce a single layer tile 42 that integrates one hardened outer side/region 46 with an opposite (non-hardened) inner side/region 44 that remains tough and energy-absorbing. According to one embodiment of the process, the diffusion hardening process may include (among others) carburization, where the tile 42 may be carburized on only one side 46 by temporarily coating the inner (i.e. tough) side 44 of the tile with a masking material suitable to prevent carburization (or other diffusion hardening) of the tile during a diffusion hardening (e.g. carburizing, etc.) operation on the entire tile (e.g. in the manner of a "stop coat" or the like on side 44 of the plate only). For example, the stop coat may be applied by coating or plating (e.g. copper plating, etc.) the entire tile 42 and then etching, or otherwise removing the plating from the exposed (outer) side 46 of the tile to be hardened. The tile 42 so treated may then be carburized to transform the exposed side 46 of the tile into a high-carbon steel alloy to a suitable depth. Alternatively, the hardening process may be conducted by any of a variety of suitable processes. For example, hardening of the outer side/region of the tile may be accomplished by carbonitriding, nitrocarburizing, or other surface hardening process.

Following transformation of the outer side/region 46 of the tile 42 from a tough low-carbon steel to a high-carbon steel alloy, the outer surface 46 of tile 42 may be boronized by any one of several processes. According to any exemplary embodiment, boronizing (e.g. boriding, etc.) is a thermochemical process in which boron atoms from a solid, liquid, gas, or plasma atmosphere surrounding the tile are diffused into the outer surface region 46 of tile 42, creating a hard, outer iron boride layer.

Surface hardening can be accomplished through any of the above processes by the diffusion of boron, carbon, nitrogen or combinations thereof, which form a hardened layer. In addition, surface modification using hardfacing, coatings, and mechanical methods are also achievable. The result of the process according to the exemplary embodiment is a single-layer, relatively thin, steel tile with an exceptionally hard exposed outer face/region that is integral with a tough, but non-brittle, steel inner substrate/region.

Referring further to FIG. 2, the armor tiles 42 are coupled (e.g. attached, bonded, joined, adhered, etc.) to the body 20 by the interposed elastomer bonding agent 30. The density of elastomer 30 may be significantly increased by filling it with heavy metallic particles such as iron; steel or tungsten (among others). The thickness, density and shear characteristics of the elastomer layer are selected to absorb the shock of impact and to spread the load imparted to the body over a wider area. According to one embodiment, the elastomer is hydraulically incompressible and is vulcanized or adhesively bonded to the tile to maximize the absorption and redirect the energy of a ballistic event.

Figure 6:
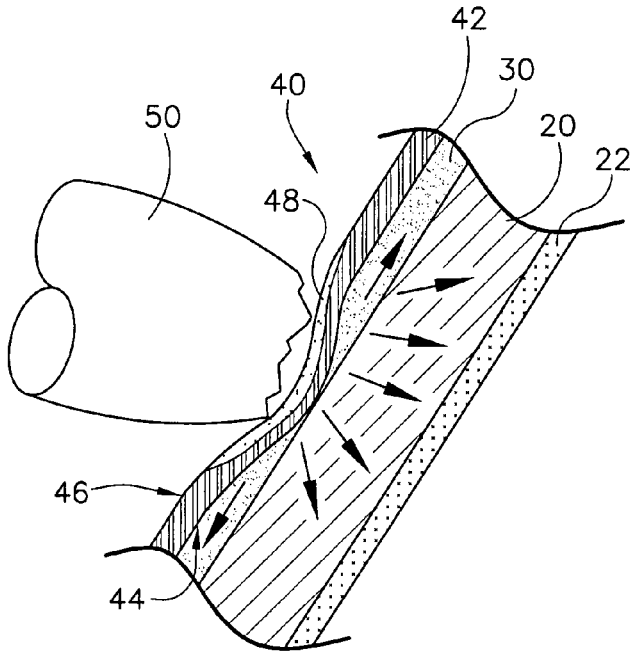
FIG. 6 is a schematic image of a detailed cross sectional view of the vehicle armor according to the embodiment of FIG. 2 upon impact by a projectile at a third stage.

Referring to FIGS. 4-6, the principle of operation of the vehicle armor is shown in successive steps according to an exemplary embodiment. The hardened outer side/region 46 of the tiles 42 serves to deflect and/or shatter the hardened point 52 of an impinging projectile 50 (such as a ballistic projectile as shown in FIG. 4, or a fragmentary projectile such as shrapnel, etc.). The tough inner tile side/region 44 is shown to deflect inward elastically and displaces the elastomer 30, which is hydraulically incompressible, laterally and radially outwards from the point of impact, thus absorbing impact energy (see FIGS. 5 and 6). At the same time, due to compressive forces in the outermost surface 46 of the tile 42 under the projectile 50, a thin layer 48 of the hardened, brittle outer surface 46 spalls free of the main body of the tile 42 by shearing laterally through the hardened outer side/region 46, to leave a rough exposed hard subsurface to abrade and continue to break-up the projectile 50. As the inner side 44 of the tile 42 stretches elastically inward, it continues to displace the high-density elastomer 30 laterally outwards away from the point of impact, further dissipating energy from the projectile. Finally, before inner side 44 of the steel tile 42 reaches its rupture stress, it physically contacts the body 20 to react the impact force from the projectile over a larger area. A spall liner 22 made from a tough, durable material, for example an aramide fiber material, such as those commercially available under the trademark Kevlar® may be affixed to the inner face of the body 20 to prevent spall injury to the vehicle's occupants or spall damage to the vehicle's systems.

According to any exemplary embodiment, the lightweight vehicle armor system provides a single-layer, relatively thin, carbon steel tile having a hardened outer surface and a non-hardened tough, energy-absorbing inner surface bonded by a high-density, particle-filled elastomer layer to a body portion of a vehicle. The body portion is preferably a stressed skin type construction comprising panels and components made from an aluminum alloy that are joined by a friction-stir-welding process. A spall liner may also be provided along all (or a portion) of the inside surface of the vehicle body. The tile may be manufactured from a ductile or tough low-carbon steel plate that is surface hardened, e.g. carburized and/or boronized on an outside surface (only) to a suitable depth to provide a hardened outer surface integrated with a tough-energy absorbing inner surface. The elastomer is preferably a hydraulically incompressible, high-density bonding agent that may be filled with particles to provide the desired shear and flow characteristics for bonding the tiles to the body portion and absorbing and dissipating impact energy from a blast or projectile. According to another embodiment, elastomer 30 may include piezoelectric capabilities, enabling the elastomer to adapt to any one of a variety of different performance characteristics through control of an electric field.

It is also important to note that the construction and arrangement of the elements of the lightweight vehicle armor system as shown schematically in the embodiments is illustrative only. Although only a few embodiments have been described in detail in this disclosure, those skilled in the art who review this disclosure will readily appreciate that many modifications are possible without materially departing from the novel teachings and advantages of the subject matter recited.

Accordingly, all such modifications are intended to be included within the scope of the present invention. Other substitutions, modifications, changes and omissions may be made in the design, operating conditions and arrangement of the preferred and other exemplary embodiments without departing from the spirit of the present invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present invention as expressed in the appended claims.

What is claimed is:

1. A stressed-skin, tiled, vehicle armor, comprising:

a body panel comprising a stressed-skin construction and having an inside surface and an outside surface;

a spall liner comprising an aramid fiber material overlying the inside surface of the body panel;

a particle-filled elastomer bonding layer overlying the outside surface of the body panel; and a plurality of single-layer tiles overlying the elastomer bonding layer, the tiles each having a hardened side and a non-hardened side.

2. The vehicle armor of claim 1 wherein the body panel is formed from an aluminum alloy.

3. The vehicle armor of claim 1 wherein the hardened side of the tiles are carburized.

4. The vehicle armor of claim 1 wherein the hardened side of the tiles are boronized.

5. The vehicle armor of claim 1 wherein the hardened side of the tiles is achieved through a diffusion process, a coating process, or a mechanical working process.

6. The vehicle armor of claim 1 wherein the elastomer is a piezoelectric elastomer.

7. The vehicle armor of claim 1 wherein the tiles comprise a carbon steel material.

* * * * *